United States Patent [19]

Aoki

[11] Patent Number: 4,877,240

[45] Date of Patent: Oct. 31, 1989

[54] PROJECTION TOY

[75] Inventor: Dai Aoki, Tokyo, Japan

[73] Assignee: Nikko Co., Ltd., Tokyo, Japan; a part interest

[21] Appl. No.: 160,860

[22] Filed: Feb. 26, 1988

[51] Int. Cl.[4] ..... A63F 9/14

[52] U.S. Cl. ..... 273/1 GA

[58] Field of Search ..... 273/1 GA; 353/101; 434/62-65, 69, 70

[56] References Cited

U.S. PATENT DOCUMENTS

| | | | |
|---|---|---|---|
| 3,060,598 | 10/1962 | Gilbert et al. | 273/1 GA X |
| 3,193,946 | 7/1965 | Patuano | 273/1 GA X |
| 4,123,050 | 10/1978 | Casado | 273/1 GA |
| 4,167,822 | 9/1979 | Weir et al. | 273/1 GA X |
| 4,352,493 | 10/1982 | Watanabe | 273/1 GA |
| 4,438,922 | 3/1984 | Suda | 273/1 GA |

FOREIGN PATENT DOCUMENTS

| | | | |
|---|---|---|---|
| 382407 | 10/1923 | Fed. Rep. of Germany | 352/101 |

*Primary Examiner*—Paul E. Shapiro

*Attorney, Agent, or Firm*—Young & Thompson

[57] ABSTRACT

A projection toy free from any condenser such as a lens or the like is disclosed, wherein a transparent window is provided at a portion of a case body in alignment with the projected surface and a projection film is disposed in the interior of the case body along the transparent window while a lamp is disposed as light source rearwardly of the projection film, a drive being provided to move the projection film. The projection toy according to the invention allows various games to be applied to running projected patterns, with the continuous patterns moved automatically or manually.

2 Claims, 6 Drawing Sheets

PROJECTION TOY

FIELD OF THE INVENTION

The present invention relates to a simple and convenient projection toy free from any condenser means such as lens or the like, and particularly to a projection toy which allows various game means to be applied to running projected patterns, with the continuous patterns moved by means of automatically or manually operated means.

BACKGROUND OF THE INVENTION

Conventionally, there has been known various types of projection toys in which projection film or the like is used. Generally, in the projection apparatus, a light source is disposed at one side of the projection film while a condenser lens is disposed at the other side thereof so that the images of the film may clearly be projected on the surface of a large screen. In this case, however, various constraints can be caused to the size of the film conditioned by the focal length of the condenser lens as well as the positional relationship between the light source, film and condenser lens to make the design and implementation of the apparatus labor-consuming, resulting in its high manufacturing cost, which, in view of the price and handling convenience, makes it unsuitable to apply this to toy especially intended for infants or schoolboys.

Besides, as the conventional simple projection toy, there has been known the type in which the light source is disposed at one side of the projection film while the film is monitored via a magnifier lens from the other side of the film but because of its appreciating purpose it lacks game enjoying element, offering no amusing point as the toy application.

An object of the present invention is therefore to provide a convenient and inexpensive projection toy which, without using any expensive and complicated projection mechanisms such as lens and the like, and by providing a light source, a relatively large-sized projection film and means for driving the film, may allow magnified and definite images of the projection film to be projected on a desired screen so that various game functions may simultaneously be achieved in correspondence with the changing images to be projected.

SUMMARY OF THE INVENTION

According to the present invention, there can be provided a projection toy in which a transparent window portion is provided at a predetermined portion of a case body in alignment with the projected surface to dispose a projection film within the interior of the case body along the transparent window while a lamp is disposed as light source rearwardly of the film, with a drive means provided for running the film.

In the above-described toy, the film is preferably cylindrically, i.e. endlessly formed and the lamp is disposed as the light source at the center thereof so that the film may continuously and rotatably be driven.

Moreover, if an externally operable running game body is provided between the window portion and the projection film so that it may run in the direction at a right angle to the running direction of the film, the projection toy equipped with the game function can readily be achieved.

PREFERRED EMBODIMENTS OF THE INVENTION

Embodiments of the projection toy made in accordance with the invention are now described in more detail with reference to the appended drawings.

Figure 1:
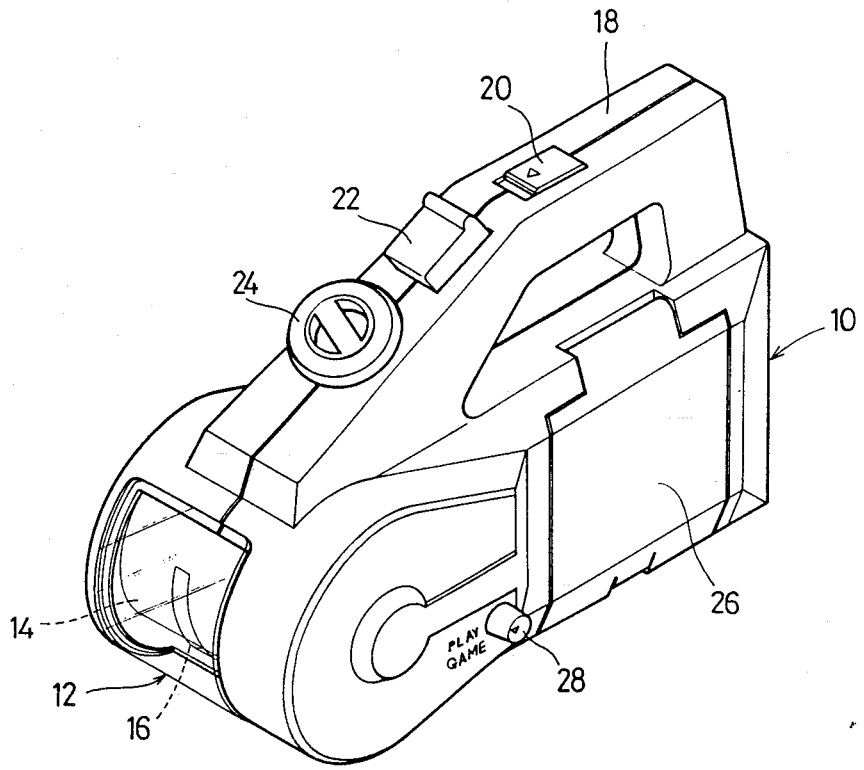
FIG. 1 is an external perspective view illustrating an embodiment of the projection toy according to the present invention.

FIG. 1 is an external view illustrating the embodiment of the projection toy according to the invention.

Namely, the projection toy is provided with a transparent window portion 12 at one end of a case body 10, inside of which are provided a cylindrical endless film 14 and a running body 16, a lamp 56 being disposed as light source at the center of said film 14, so that the latter 14 and the running body 16 can be projected onto the screen such as the surface of a wall or the like.

Yet the projection toy of the present invention may respectively be provided in the interior thereof with a drive means for rotationally driving the film 14, an operation means for moving the running body 16, and a portion for housing battery as power supply. These means will be described later in more detail.

Consequently, the projection toy shown in FIG. 1 is provided with a manually handled portion 18 at the upper portion of the case body 10, on which are provided a lamp switch 20 for switching the lamp on and off, a drive switch 22 for rotatingly driving the projection film 14 and a handle 24 for manually operating the running body 16, a lid 26 for covering the battery housing portion and a switch 28 for switching games being further provided at one lateral surface of the case body 10.

Figure 2:
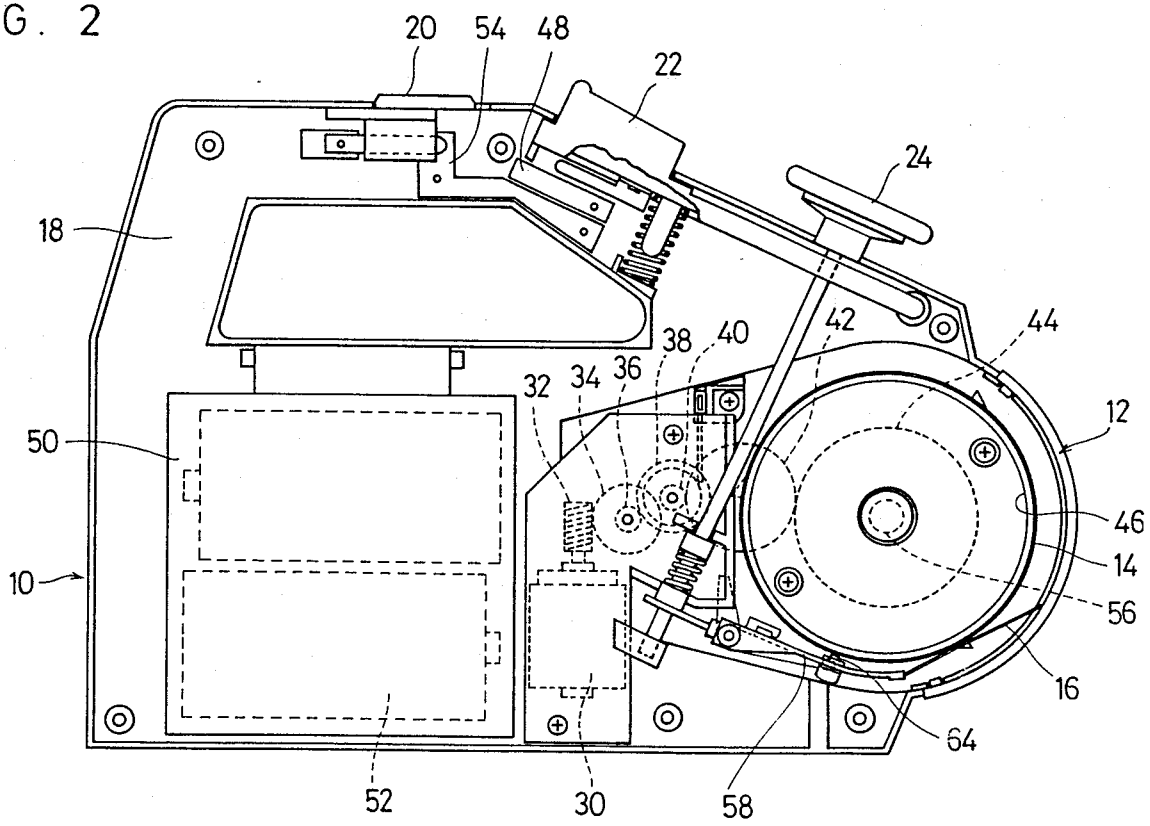
FIG. 2 is a plan view of the internal arrangement of the embodiment of FIG. 1 illustrating the positional relationship between the principal internal mechanism and the externally operable means of the projection toy.
Figure 3:
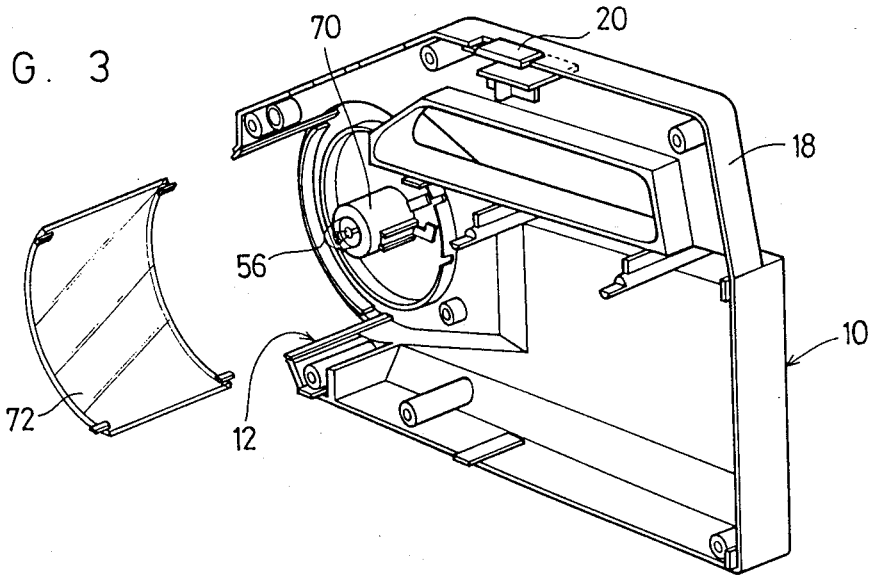
FIG. 3 is an enlarged perspective view of the principal mechanism of the projection toy shown in FIG. 2.

Next, the internal construction of the toy is described in detail. FIGS. 2 and 3 respectively illustrate a drive means for driving the above-mentioned endless film 14, and operating means for operating the running body 16. First, the former drive means is provided with an electric motor 30 for use as a rotary drive source and which via the first, second, third, fourth and fifth gears 34, 36, 38, 40, 42, engages the sixth gear 44 axially coupled with a disc-shaped rotary support 46 which supports the film 14 by means of a worm 32 coupled with the drive shaft of the motor 30. As a result, thus constructed, the drive means, when the drive switch 22 is pressed from the exterior, allows a contact portion 48 to be closed to connect the battery 52 housed in the portion 50 to the motor 30 to energize it, thereby rotating the film 14 at a slow speed in a predetermined direction. At this time, if the lamp switch 20 is slid in the direction of the arrow to open the contact portion to thereby light the lamp 56, the image portion of the film 14 located at the window 12 and the running body can be projected on the screen in magnified manner.

Besides, the operation mechanism for operating the running body 16 is provided with a rectilinear running plate 58 located somewhat rearwardly of the window 12 and adjacent the outer peripheral surface of the film, and a display portion 60 for displaying the running body is mounted at one end of the running plate 58, extending toward the window portion 12 while a rack 62 is provided at the other end thereof so that a pinion 66 which engages the rack 62 may be coupled with the tip portion of the operation lever 68 coupled with the handle 24.

Consequently, the operation mechanism thus constructed allows the running plate 58 to be moved to any location with respect to the longitudinal direction of the film 14 so that the position 60 of the display portion which is to be projected on the screen may be changed.

Figure 4:
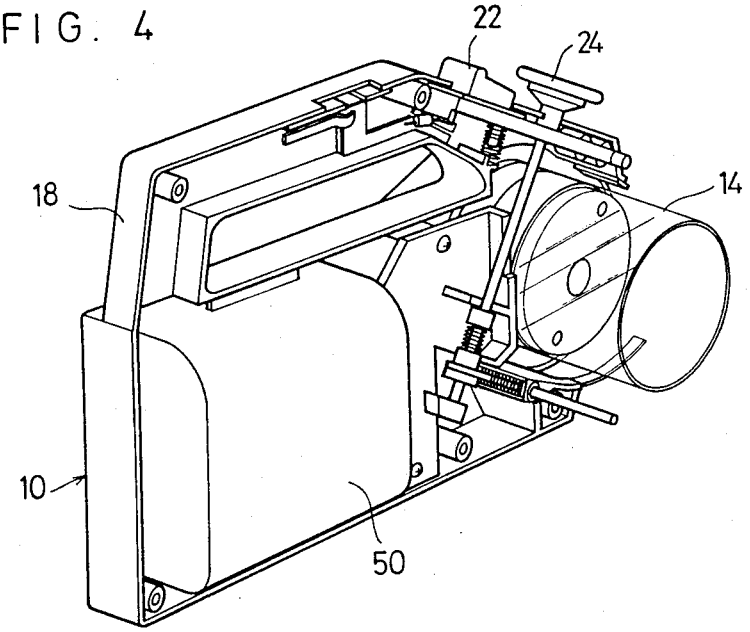
FIGS. 4 and 5 are perspective views respectively illustrating either of the pair of halves or the toy assembly shown in FIG. 1.
Figure 5:
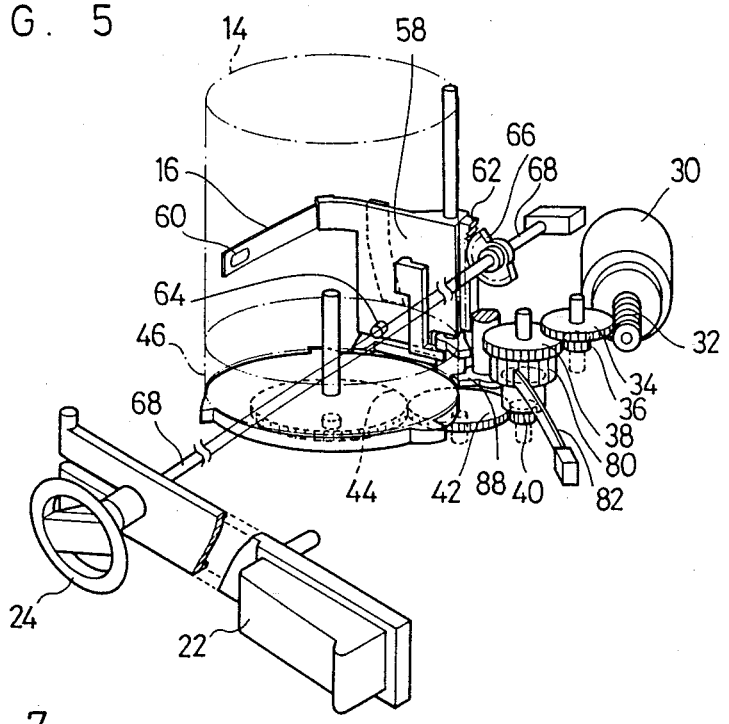

FIGS. 4 and 5 respectively illustrate the assembled state of the projection toy according to the preferred embodiment of the invention, and the case body 10 and the portion 18 are respectively composed of two separable halves, one half (See FIG. 4) storing practically all of the mechanisms shown in FIGS. 2 and 3, and the other (See FIG. 5) storing the lamp 56 as light source.

Preferably, the lamp 56 is removably held in a holder member 70 and can be replaced from the exterior of the half of the case body 10.

Figure 8:
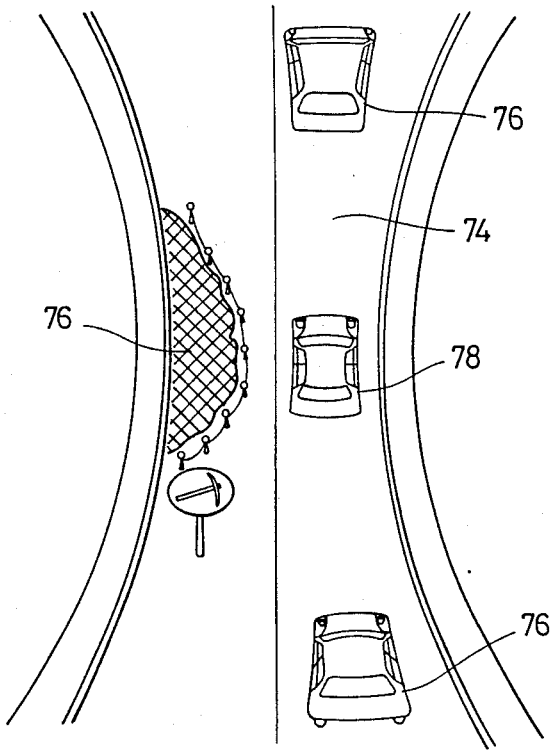
FIG. 8 is an explanatory view illustrating the working condition and the game function of the projection toy of FIG. 1.

Besides, as shown in FIG. 5, a transparent plate 72 curved in accordance with the radius of curvature of the cylindrical film 14 is removably attached to the transparent window 12. Consequently, in accordance with the embodiment thus arranged, as shown in FIG. 8, games can be enjoyed by printing pictures on the film in which various obstacles 76 are drawn along the continuous road 74, with a predetermined car body 78 printed on the display portion 60 of the running body 16. In other words, the lamp switch 20 and the drive switch 22 are turned on to light the lamp 56 while the projection film 14 is rotationally driven to project this film onto the desired screen, and then the car body 78 can be moved not to collide with the obstacles by properly operating the handle 24 in unison with the rotation speed of the film 14.

Furthermore, in order to improve the game function of the projection toy of the invention, as shown in, for example, FIG. 3, an acoustic gear 80 is coupled with the third and fourth gears 38 and 40 coaxially coupled with each other, and a plastic oscillating plate 82 one end of which is fixed is abutted at its free end thereagainst so that as the gear rotates the oscillating plate 82 may continuously beat the addendum of the gear 80 to produce the intended discontinuous sounds, thereby acoustically indicating the operating state of the game running body 16 projected on the screen. Besides, at one lateral edge of the running plate 58 of the running game body 16 is provided opposite thereto a claw 64 which protrudes toward the peripheral surface of the rotary support 46.

Figure 7:
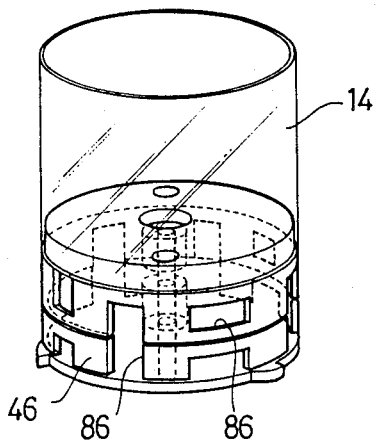
FIG. 7 is a schematic perspective view of the principal mechanism of FIG. 6.
Figure 6:
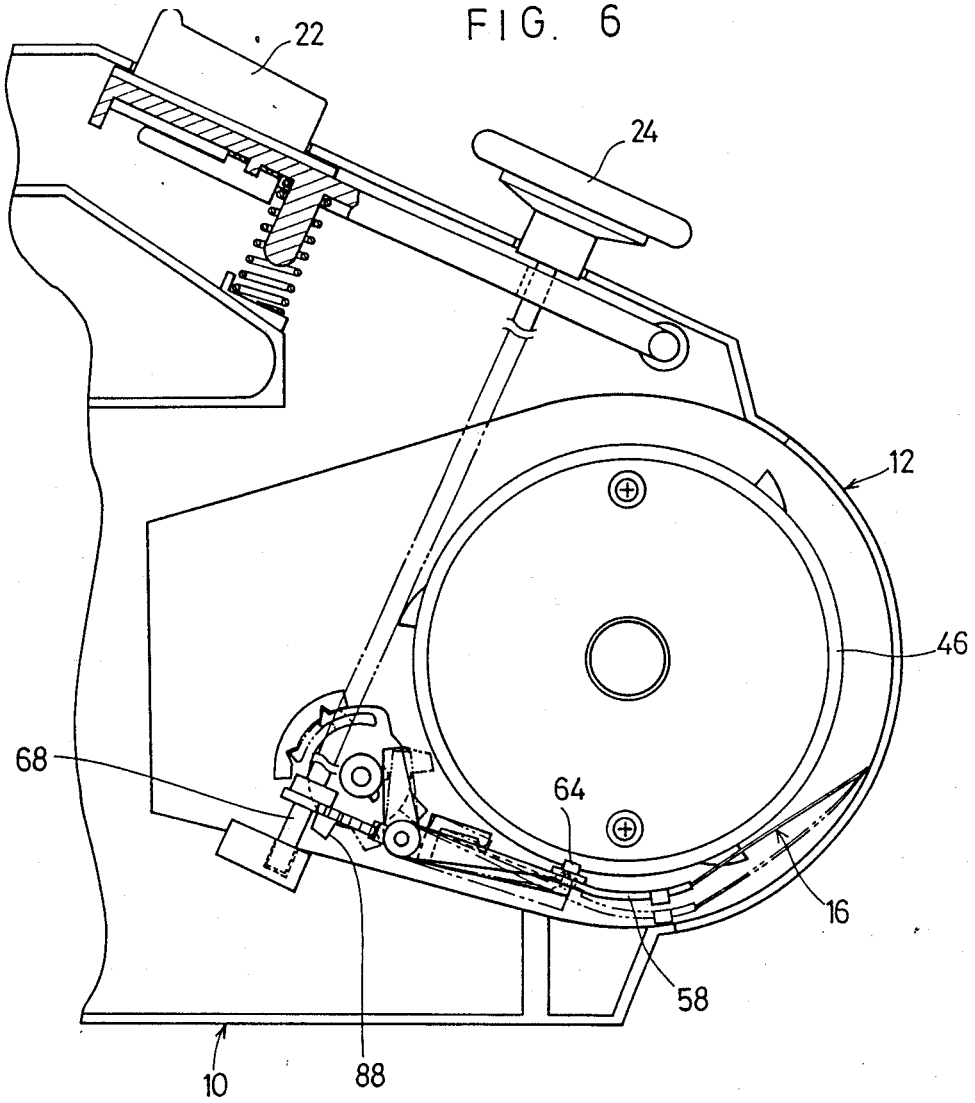
FIG. 6 is an explanatory plan view illustrating how the principal mechanism of the projection toy of FIG. 1 may operate.

Various groove portions 86 are provided on the outer peripheral surface of the rotary support 46, displaced in the direction of its width in correspondence with the content of the game (in the figure obstacles placed along the road) drawn on the film 14 so that, for example, when the car body 78 projected on the screen collides with the obstacles placed on the road 74, the aforementioned claw 64 may be fitted into the groove portions 86 of the support 46 to temporarily and forcibly stop the rotation of the support 46 (See FIGS. 6 and 7). In this case, when the claw 84 of the running plate 58 coincides with the groove portion 86, they may be forcedly fitted with each other to stop the support 46, or instead the support 46 may be freely rotated. To this end, a switchable clutch means 88 may be provided and the means 88 may be operated from the exterior by the switch 28 shown in FIG. 1.

Incidentally, in the instant projection toy, without being limited to the above-described embodiment, the projection film may be arranged so as to be laterally moved, or may be used as mere projection toy with no game means applied thereto, or as a lantern slide by replaceably inserting a single projection film into the transparent window.

Additionally, since the instant projection toy uses no condenser means such as lens, there is no need to conduct complicated focusing and proper projection can conveniently and inexpensively be achieved by forwardly and rearwardly moving the screen body with respect to the proper screen, which allows it to be used not only for the infants but also for the adults.

Furthermore, in the instant projection toy, in view of its projecting function, since the relatively largesized film is also effective, it is possible to prepare the handmade film, having an extremely wide range of application as toy.

Furthermore, in the projection film to be used for the instant projection toy, a rectilinear film cassette at one lateral edge of which the rack is provided is disposed and the film is linearly attached to this cassette in parallel to the intended transpartent window to insert it from its one lateral edge so that it may be moved in a predetermined direction in engagement with a pinion provided at the drive means including the rack. The projection toy thus constructed allows it to be properly combined with a shooting game means.

Although the present invention was hereinbefore described with reference to the preferred embodiment thereof, various changes and modifications can of course be made thereto without being limited to those ones, and without departing from the spirit of the invention.

What is claimed is:

1. A projection toy with a game function comprising a case body having a transparent window, a cylindrical transparent film within the case body in alignment with the window, a lamp within the cylindrical film to shine through the film to project on a remote surface an image on the film, a running game body overlying the film to cast a shadow on the remote surface in the light from the lamp, a moving plate on which the running body is mounted, means operable from the outside of the case body to move the moving plate parallel to the axis of the cylindrical film to move the position of the shadow cast by the running body in a direction parallel to the axis of the film, a rotary supporting member that carries the film for rotation about the axis of the film, an electric motor within the case body connected by gearing to the rotary supporting member to rotate the rotary supporting member and the film, the rotary supporting member having plural groove portions therein displaced from each other in a direction parallel to the axis of the film, said moving plate having a protrusion thereon that is selectively engageable in said groove portions to temporarily stop the rotation of said rotary supporting member.

2. A projection toy as claimed in claim 1, said gearing including a sound generating gear, and a resilient plate fixed to said case body at one end and having a free end engaging said sound generating gear to generate noise upon rotation of said sound generating gear.

* * * * *